US010905621B2

(12) United States Patent
Maichel et al.

(10) Patent No.: US 10,905,621 B2
(45) Date of Patent: Feb. 2, 2021

(54) MASSAGE DEVICE

(71) Applicant: Braun GmbH, Kronberg (DE)

(72) Inventors: Michael Maichel, Landsberg am Lech (DE); Bjoern Kling, Glashuetten-Oberems (DE)

(73) Assignee: Braun GMBH, Kronberg (DE)

( * ) Notice: Subject to any disclaimer, the term of this patent is extended or adjusted under 35 U.S.C. 154(b) by 320 days.

(21) Appl. No.: 15/685,618

(22) Filed: Aug. 24, 2017

(65) Prior Publication Data

US 2018/0055719 A1 Mar. 1, 2018

(30) Foreign Application Priority Data

Aug. 25, 2016 (EP) ..... 16185735
Aug. 21, 2017 (EP) ..... 17187075

(51) Int. Cl.
*A61H 7/00* (2006.01)

(52) U.S. Cl.
CPC ..... *A61H 7/002* (2013.01); *A61H 7/005* (2013.01); *A61H 2201/01* (2013.01); *A61H 2201/169* (2013.01); *A61H 2201/1692* (2013.01)

(58) Field of Classification Search
CPC ..... A61H 7/002; A61H 39/00; A61H 39/04; A61H 2201/1685; A61H 2201/1692
See application file for complete search history.

(56) References Cited

U.S. PATENT DOCUMENTS 2,392,091 A * 1/1946 Kieft ..... A47K 1/08 248/206.4
2,513,772 A 7/1950 Amer
9,039,641 B1 5/2015 Johnson
2007/0066919 A1* 3/2007 Gueret ..... A61H 7/003 601/138
2013/0023806 A1* 1/2013 Ungemach ..... A61H 7/005 601/114
2014/0276280 A1 9/2014 Oller, Jr.
(Continued)

FOREIGN PATENT DOCUMENTS

CN 1960659 C 9/2009
CN 203777277 U 8/2014
CN 104519852 A 4/2015
(Continued)

OTHER PUBLICATIONS

European search report dated Feb. 8, 2017.
(Continued)

*Primary Examiner* — Timothy A Stanis
(74) *Attorney, Agent, or Firm* — Kevin C. Johnson

(57) ABSTRACT

The present disclosure is concerned with a massage device having a massage pad being made from an elastic material and having a base with a convex base surface, and at least one massage projection extending from the base surface, which massage projection having a base and a tip having a tip center, and a hard carrier, the massage pad being connected with the hard carrier at its circumference and a clearance being provided between the massage pad and the hard carrier at least in a center region of the massage pad, wherein the clearance is being structured so that the massage pad can deform into a concave state at least in the center region.

16 Claims, 5 Drawing Sheets

(56) References Cited

U.S. PATENT DOCUMENTS

2015/0209220 A1* 7/2015 Lin ..... A61H 15/0092
601/119

FOREIGN PATENT DOCUMENTS

| | | | |
|---|---|---|---|
| CN | 103702649 | B | 10/2016 |
| CN | 109451725 | A | 3/2019 |
| DE | 202015104519 | U1 | 9/2015 |
| DE | 202015005165 | | 12/2015 |
| EP | 2443958 | | 4/2012 |
| EP | 2460437 | | 6/2012 |
| EP | 2550948 | A1 | 1/2013 |
| EP | 3287115 | A1 | 2/2018 |
| GB | 2332367 | A | 6/1999 |
| JP | 03198854 | A | 8/1991 |
| JP | 8141030 | A | 6/1996 |
| JP | 2010162182 | A | 7/2010 |
| JP | 2010167047 | | 8/2010 |
| JP | 2011125514 | A | 6/2011 |
| JP | 2012187219 | A | 10/2012 |
| JP | 2016123723 | A | 7/2016 |
| JP | 2019524336 | A | 9/2019 |
| KR | 101385515 | | 4/2014 |
| KR | 20190032520 | A | 2/2020 |
| WO | 2011105212 | A | 9/2011 |
| WO | 2013189142 | A1 | 12/2013 |
| WO | 2018037344 | A1 | 3/2018 |

OTHER PUBLICATIONS

Sara Teissier; Communication pursuant to Article 94(3); European Patent Application No. 17187075.1; dated Jul. 11, 2019; European Patent Office; Munich, Germany.

Notice of Preliminary Rejection; Korean Patent Application No. 10-2019-7005382; dated May 13, 2020; Korean Patent Office; Daejeon, South Korea.

First Office Action dated Jun. 2, 2020; Application No. 201780044243.7; The State Intellectual Property Office of People's Republic of China.

EPO Communication and Annex dated Apr. 3, 2020; Application No. 17187075; European Patent Office.

EPO Search Opinion dated Nov. 21, 2017; Application No. 17187075; European Patent Office.

EPO Search Report dated Nov. 16, 2017; Application No. 17187075; European Patent Office.

Notice of Reasons for Refusal dated Feb. 4, 2020; Application No. 2019-508215; Japanese Patent Office.

Chinese Search Report dated May 26, 2020; Application No. 201780044243.7; The State Intellectual Property Office of People's Republic of China.

Japanese Search Report dated Jan. 7, 2020; Application No. 2019-508215; Japanese Patent Office.

International Search Report and Written Opinion dated Nov. 23, 2017; Application No. PCT/IB2017/055065; European Patent Office.

* cited by examiner

MASSAGE DEVICE

FIELD OF THE INVENTION

The present disclosure is concerned with a massage device comprising a massage pad having one or more massage projections.

BACKGROUND OF THE INVENTION

It is known that elastic massage device can comprise a massage pad having massage projections for massaging various parts of the human or animal body. A massage device may be used to rub the massage pad over the foot sole to experience the massage benefits (e.g. increased blood circulation or relief of hardened muscles). The massage device is arranged to drive the massage pad into motion. It is known that the massage projections may have a general dome-like shape such as a semi-spherical form and massage pads are available were the massage projections have an additional structure such as circular dots.

Document JP 2010/167047 A describes an electric brush device for washing or massaging the scalp, which device comprises a flexible substrate and a plurality of projections provided on the substrate. A reciprocating drive means is provided inside the device body for repeatedly deflecting the substrate, e.g. from a convex state into a concave state and vice versa.

It is a desire to provide a massage device with a massage pad that is improved over the known massage devices or that provides at least an alternative over the known massage devices.

SUMMARY OF THE INVENTION

In accordance with one aspect a massage device is provided that has a massage pad being made from an elastic material and having a base with a convex base surface, and at least one massage projection extending from the base surface, which massage projection having a base and a tip having a tip center, and a hard carrier, the massage pad being connected with the hard carrier at its circumference and a clearance being provided between the massage pad and the hard carrier at least in a center region of the massage pad, wherein the clearance is being structured so that the massage pad can deform into a concave state at least in the center region.

BRIEF DESCRIPTION OF THE DRAWINGS

The present disclosure and the proposed massage pad and massage device are further elucidated by a detailed description and with reference to figures. In the figures

DETAILED DESCRIPTION OF THE INVENTION

Figure 1A:
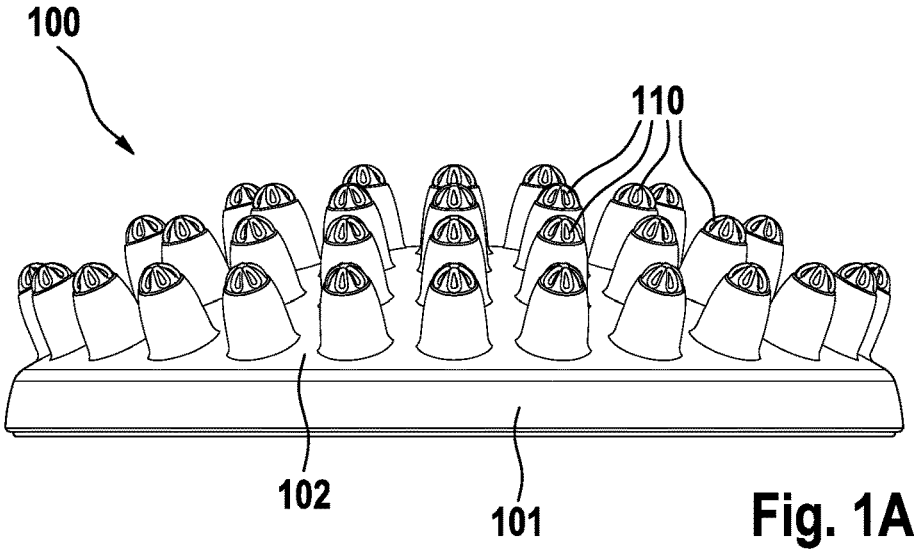
FIG. 1A is a side view onto an example massage pad.

A massage device as proposed in the present description serves two aims, namely on the one hand to provide a massage effect (e g enhanced blood circulation in the massaged skin areas) and on the other hand to provide an adaptability to differently shaped body portions so that the massage pad (and in particular massage projections on the massage pad) is in good contact with the massaged body portion.

The electric brush device as described in previously mentioned document JP 2010/167047 A does not provide a good adaptability to various body portions as in this device the elastic substrate is held by a diving means that repeatedly deflects the elastic substrate so that the fingers on the substrate essentially massage the scalp as a human hand would massage the scalp. The device is not intended to adapt to other body portions having varying contours, but is arranged to essentially not adapt under an external force at all. E.g. an upper leg has relatively soft contours, while an elbow or a knee have relatively strong contours. A massage device in accordance with the present description has the ability to easily adapt to these different body contours.

The present disclosure focuses on the one hand on the massage pad itself and in particular on massage projections where a least one massage projection is structured (i.e. has at least one elongated depression or elevation), which massage pad can be used in a massage device as proposed, and the present disclosure focuses on the other hand on a massage device with arbitrary massage projection(s) (e.g. unstructured massage projections), but which massage device is arranged so that the massage pad can deflect from a convex shape into a deformed state under the application of an external force acting onto the massage pad (e.g. the external force is applied by the body portions when the user guides the massage device over the skin).

The present disclosure is specifically concerned with a massage device comprising a massage pad being made from an elastic material and having a base with a convex base surface, and at least one massage projection extending from the base surface, which massage projection has a base and a tip having a tip center, and comprising a hard carrier, the massage pad being connected with the hard carrier at its circumference and a clearance being provided between the massage pad and the hard carrier at least in a center region of the massage pad, in particular wherein the clearance is structured so that the massage pad can deform into a concave state at least in the center region. The massage pad may in particular have at least one groove-like depression providing a deformation line under an applied external force so that the massage pad deforms in an essentially predefined manner. The groove-like depression may in particular be arranged on an inner surface opposite of the massage pad opposite to the base surface to define the deformation line for the massage pad under an applied external force, in particular wherein the groove-like depression is ring-like. Further in particular, at least two ring-like depressions may be provided that are arranged concentric to a center point of the massage pad (where here the center point is defined as the center of area of the massage pad). A center axis of the massage pad is then defined as the axis that extends through the center point and that is perpendicular to the outer base surface of the massage pad at the center point in the unloaded state of the massage pd. The massage pad may in particular be circular. The at least one groove-like depression may extend between massage projections.

The massage pad of this massage device may in particular comprise one or several of the herein described structured massage projections and/or one or several non-structured massage projections. This massage device may in particular comprise a drive for driving the carrier into a motion, in particular a rotating or oscillating rotating motion around a rotation axis that extends through the center point of the massage pad, even though other motions shall not be excluded, e.g. an eccentric motion of the carrier so that the massage pad is moved similar to the grinding pad of a grinding device. The described possibility of the massage pad to deform under an applied external force from a convex base state into an at least partially concave state allows adapting of the massage pad to contoured skin surfaces as are prominently present in the elbow or knee region, but the massage pad also deforms in order to adapt to all other body contours. In the underarm pit, the massage pit may essentially stay in its concave shape as may be the case when massaging the foot sole. Other body contours may at least partially deform the massage pad into a concave shape. The strength of deformation is in particular controllable by the user, i.e. by the force with which the user pushes the massage pad against the skin.

For the purposes of the present disclosure, it shall be assumed that the term "elastic material" shall mean an elastomeric material (i.e. a polymer having elastic properties) having a Shore A hardness in the range of between 3 and 90, in particular in the range of between 10 and 80, and this includes in particular the vulcanizates of unsaturated rubber (e.g. natural rubber) and cured unsaturated rubbers (e.g. cured silicone rubber) but also other types of elastomers (e.g. thermoplastic elastomers—TPEs) in this hardness range.

In order to provide a pleasant massage experience, the massage pad is made from an elastic material having a certain elasticity (or hardness). The Shore A hardness of the massage pad may be in a range of between 20 and 70, in particular in a range of between 25 and 60, and further in particular in a range of between 40 and 50, but ranges like in between 20 and 40, 50 and 70, 25 and 45, 45 to 65, 35 to 55 etc. are considered as well. Different hardness ranges may be suited for different massage intentions or for different types of users. E.g. while some users may prefer a soft massage experience, other users may prefer a more effective (e.g. stronger) massage experience. Also, the precise shape of the massage projections and details like the edge radius of the depressions or elevations influence the massage experience, both—subjectively and objectively. Silicone elastomers are one range of materials suitable for a massage pad, while other elastomers in the mentioned Shore A hardness range are considered as well. A wide variety of silicone materials having Shore A hardness in a range of between 3 and 90 is available from, e.g., Wacker Chemie AG, Munich, Germany. Examples are e.g. materials from the ELASTOSIL® LR 3003 family available with Shore A hardness of e.g. 10, 20, 25, 30, 40, 50, 60, 70, or 80. Instead of its hardness, elastic materials may be characterized by their Young's modulus, which for elastomeric materials may lie in the range of between 0.5 $N/mm^2$ to 50 $N/mm^2$, in particular of between 0.6 $N/mm^2$ and 20 $N/mm^2$, further in particular of between 0.8 $N/mm^2$ and 10 $N/mm^2$ and even further in particular in the range of between 0.9 $N/mm^2$ to 5 $N/mm^2$ (these ranges do not necessarily coincide with any of the given Shore A hardness ranges; while scientist have derived some non-linear relationship between Shore A hardness and Young's modulus for elastomers, no such relationship is meant to be indicated between the ranges provided herein).

The massage pad as proposed comprises at least one or a plurality of massage projections that extend from a base surface of the massage pad and each of the massage projections has a base (where the massage projection is rising out of the base surface) and a tip, i.e. the free end of the massage projection, where the tip has a tip center. The tip of the massage projections is intended to come into contact with the skin of a user during the use of the massage device. It is known to provide massage pads with massage projections in order to provide a pleasant and effective massage experience. In order to also provide effective skin abrasion with the elastomeric material, at least one of the massage projections may be structured and may have an elongated depression or elongated elevation located at the tip ("structured massage projection"), in particular where the elongated depression or elongated elevation extends non-circular symmetric with respect to the tip center (e.g. not in the form of a ring). The elongated depression or elongated elevation may in particular extend along a radial line originating at the tip center. To some extent depending on the Shore A hardness of the elastic material, the elongated depression or elevation may have an edge (i.e. the outer edge that comes into contact with the skin) with an edge radius in the range of between 0.05 mm to 0.20 mm, in particular of about 0.10 mm, so that the edge of the elongated depression or elongated elevation provides a certain scraping function. In some embodiments, a plurality of structured massage projections is disposed on the massage pad. In some embodiments, all massage projections are structured massage projections.

The structured massage projection may have one of various forms. In some embodiments, the at least one structured massage projection has a generally dome-shaped form, where the diameter of the dome is in the range of between 3.0 mm to 5.0 mm, in particular about 4.0 mm, and the height of the dome is in a range of between 3.0 mm to 10.0 mm, in particular in a range of between 4.0 mm to 7.0 mm, and further in particular in a range of between 4.5 mm and 6.0 mm such as 5.2 mm. The height (or depth) of the elongated elevation (or depression) may be in the range of between 0.05 mm and 1.0 mm, in particular in the range of between 0.10 mm and 0.50 mm, further in particular in the range of between 0.15 mm and 0.30 mm such as 0.20 mm.

In case the massage projection has a generally circular cross sectional shape with a decreasing diameter towards the tip (i.e. the cross sectional shape is determined in planes that are perpendicular to an extension axis that extends through a center point of the cross sectional shape at the level of the base surface and through the tip center), an enveloping outer surface can be defined that has a generally dome-like shape, i.e. is cylinder-symmetric with respect to the extension axis.

Generally, a central area may be arranged between the base of the massage projection and the tip, which central area may then be unstructured (which shall not exclude that the surface of the massage projection has a certain surface roughness, e.g. where the arithmetic average profile roughness Ra is in the range of between 0.1 μm and 20 μm, in particular in the range of between 0.5 μm and 5 μm, and further in particular where this value is about 1 μm.

In some embodiments, at least one structured massage projection has at least two elongated depressions and/or elevations (e.g. one depression and one elevation) and may in particular comprise three, four, five, six, seven, eight, nine, or ten depressions and/or elevations. The plurality of elevations and/or depression may originate at or close to a center of the tip of the structured massage projection, in particular the depressions and/or elevations may be equidistantly arranged around the tip center (e.g. the depressions and/or elevations may extend along radial lines that originate at the tip center and have equiangular distance—in case of five depressions and/or elevations the angular distances between the radial lines is 72 degrees). In some embodiments, the depressions and/or elevation may converge into a center zone at the tip center and/or they may converge into a ring-like elevation or depression that extends around the massage projection at the border between the tip and the center area.

An elongated depression or elevation either has a symmetric form that allows defining a longitudinal center axis through the depression or elevation or the long axis of an approximation ellipse is used to define the longitudinal center axis. The approximation ellipse of an elongated elevation or depression is the ellipse having smallest area that still comprises the shape of the elevation or depression.

The massage pad may have a plurality of structured massage projections, e.g. the massage pad may have two, four, six, eight, ten, twelve or more structured massage projections. The massage pad may have at least 24 structured massage projections, at least 36, or at least 48, or at least 60 or at least 72, or at least 84, or at least 96 massage projections. The plurality of structured massage projections may in particular be arranged in one or more rings around a center point. In case of a massage device comprising such a massage pad, the massage pad may be arranged for driven rotation or oscillatory rotation, where the rotation axis extends through the center point of the ring arrangement. This shall not exclude other driven motions such as, e.g., an eccentric or orbital motion of the massage pad like a grinding pad (e.g. circular sandpaper) of a grinding machine (e.g. disc sander or orbital sander) or a linear vibration. Generally, the massage pad may also comprise a plurality of non-structured massage projections, e.g. in a ring arrangement every other massage projection may be unstructured. By such a mixture the abrasive effect can be controlled. In case of more than one structured massage projection, the structured massage projections may have differently structured tips, e.g. one type of structured massage projections may have at least one elongated depression and the other type of massage projections may have at least one elongated elevation. Further, the massage pad may comprise at least one massage projection that has a circular or non-elongated depression or elevation.

The massage pad is mounted on a hard carrier. While it is generally not excluded that a massage pad made from an elastic material may be used as it is (e.g. the massage pad may comprise a loop for holding the massage pad or the massage pad may comprise receptacles for accommodating one or more fingers of a hand), a carrier made from a hard material (e.g. a hard plastic material having a Shore D hardness in a range of between 55 and 100 or a Young's modulus in the range of between 200 $N/mm^2$ and 10.000 $N/mm^2$, which shall not exclude that the hard material may be a ceramic material, a metal, glass etc.) supports the handling of the elastic massage pad (e.g. the carrier may be formed as a handle suitable for being grasped by a user's hand) and the carrier may support that the elastic massage pad is connectable to a handle of the massage device (in particular an electric massage device). Suitable plastic materials for a hard carrier include but are not limited to polypropylene (PP), polyethylene (PE), polycarbonate (PC), and acrylic (PMMA).

The massage pad is connected at its circumference with the carrier (e.g. a circumferential groove may be provided at the hard carrier for receiving a circumferential connecting structure of the massage pad) so that a clearance is provided at least between a center region of the massage pad and the hard carrier, which clearance may become smaller towards the circumference of the massage pad. The massage pad has a convex base so that the area of the massage pad becomes larger than the planar area defined by the circumference of the massage pad. The massage pad may have at least one groove-like depression in its base, where the groove-like depression is in particular provided in a bottom surface of the base opposite to the base surface from which the massage projections extend. The grove-like depression may in particular be ring-like and may be arranged concentric to a center point of the massage pad. Such a groove-like depression serves to provide deformation lines around which the massage pad deforms when a force is applied at the massage pad so that a particular deformation behavior of the massage pad can be defined. For a ring-like depression (or two or more such ring-like depressions) arranged around a center point of the massage pad around which the massage may also be moved, the depression(s) weaken the base of the massage pad in radial direction but not in circumferential direction. That means that the massage projections, which may in particular be driven to move circumferentially, are not weakened against bending at their base in this circumferential direction (and thus maintaining a good massage effect). In the design of the massage pad, it needs to be balanced between achieving a good adaptability of the pad to contoured skin portions (e.g. around the knee or the elbow)—which requires that the base is not too thick—and a certain stability of the massage projections—which requires a certain minimum thickness. The groove-like depressions allow having a general high thickness of the massage pad base (good massage effect as the massage projections do not easily bend away), while allowing a good adaptability. As was explained above, the here discussed arrangement of the massage pad is also relevant for a massage pad where the massage projections are generally unstructured.

Figure 1B:
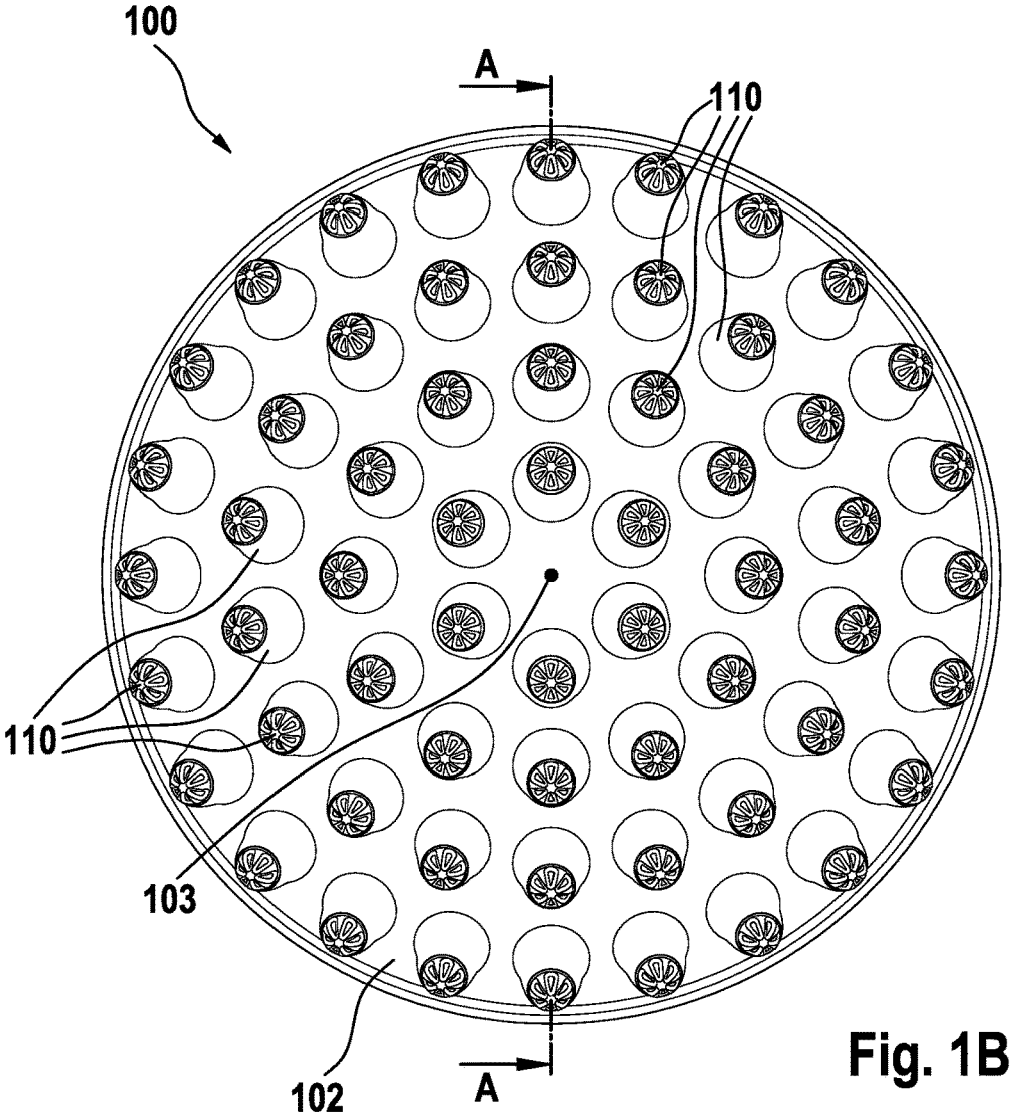
FIG. 1B is a top view onto the massage pad shown in FIG. 1A.

FIG. 1A is a side-view onto an example massage pad 100 in accordance with the present disclosure and FIG. 1B is the respective top view onto the massage pad shown in FIG. 1A. The massage pad 100 has a base 101 having a base surface 102 from which a plurality of massage projections 110 extend. The massage pad 100 had a generally circular base 101 as can be seen in FIG. 1B and the base is generally convex with respect to its outer side (which is the base surface 102). In the shown embodiment, the massage projections 110 are located in four concentric rings around a center 103 of the circular massage pad 100, where the innermost ring has six massage projections, the second ring has 12 massage projections, the third ring has 18 massage projections, and the fourth ring has 36 massage projections, so that the shown massage pad 100 comprises 72 massage projections 110. Each of the massage projections 110 is here shown as being a structured massage projection. As will be discussed more in-depth in connection with FIGS. 2A, 2B, and 3, each of the massage projections 110 has a base or foot-area where the massage projection 110 extends out of the base 101 of the massage pad, a center area, and a tip having a tip center. In accordance with the present disclosure, at least the tip of at least one massage projection comprises an elongated elevation or depression.

It is to be noted that the shown massage pad 100 is just one very specific example of a massage pad in accordance with the present disclosure and the base of the massage pad may take any shape, e.g. a quadratic or generally square shape, a triangular shape, an annulus-like shape, a polygonal shape, an oval or elliptical shape, or—of course—any other arbitrary shape. Likewise, the number of massage projections is arbitrary as well and may be chosen by the skilled person due to the size of the massage pad, the size of the massage projections and the general intention of the massage effect. In particular, the location of the massage projections on the massage pad may be rather random or inhomogeneous than symmetric or homogeneous. Each of the massage projections may have a different shape and/or geometric dimensions while in some embodiments, various groups of massage projections having identical shape and geometric dimensions within each of the groups, but which shape and geometric dimensions vary between the groups.

Figure 2A:
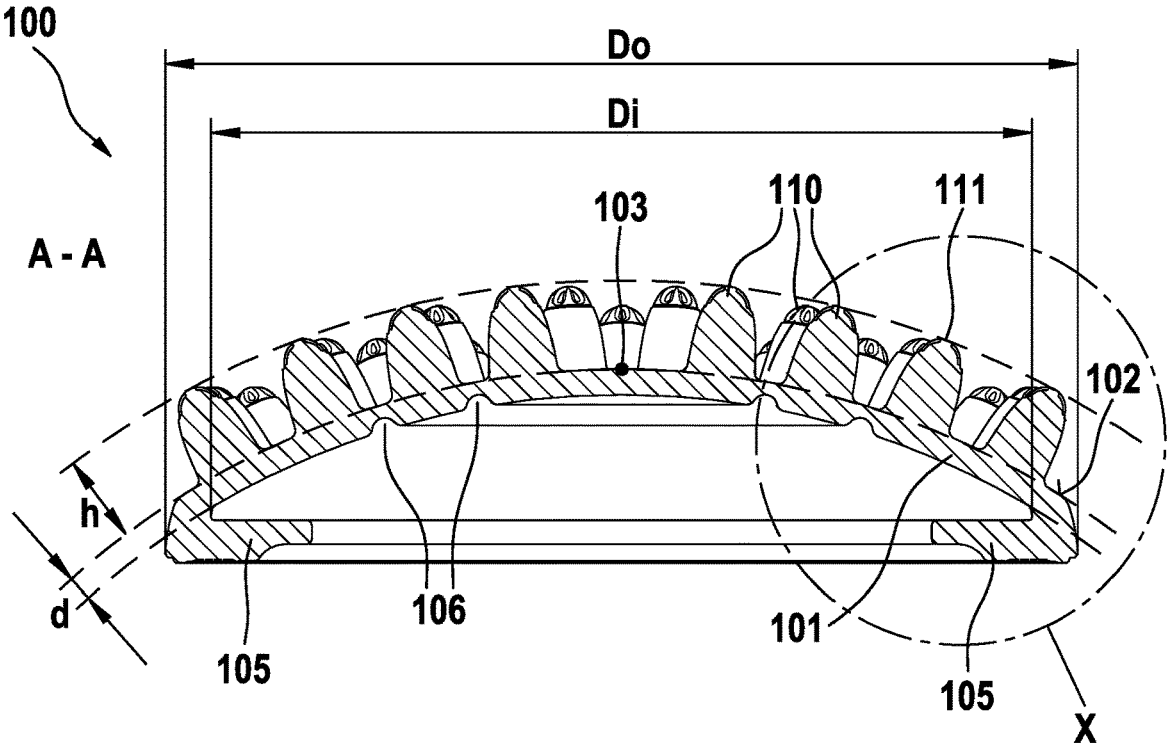
FIG. 2A is a cross-sectional cut through the massage pad shown in FIG. 1B along plane A-A as indicated in FIG. 1B.

FIG. 2A is a cross-section through the massage pad 100 as shown in FIGS. 1A and 1B taken along plane A-A as indicated in FIG. 1B. It can be seen that the convexly outwards bulging base 101 of the massage pad 100 has an essentially constant thickness d, where in the shown embodiment groove-like depressions 106 extend in the inner side of the base (i.e. the side of the base 101 being opposite to the base side 102), which groove-like depressions provide lines (here: rings) of reduced stability of the base 101 and thus these rings define predetermined bending lines. Further, the massage pad 100 comprises a circumferentially arranged inwards extending ring 105 arranged for engaging with a carrier as will be discussed more in detail with reference to FIG. 4. The circular massage pad 100 has an outer diameter $D_o$ and an inner diameter $D_i$. The height h of each of the massage projections 110 is measured between the level of the base surface 102 and the tip center 111 and may have a value of about 5.2 mm More generally, all of the massage projections of a massage pad described herein may have the same height, so that the tips of the massage projections lie on an identically shaped convex surface as the outer base surface.

Figure 2B:
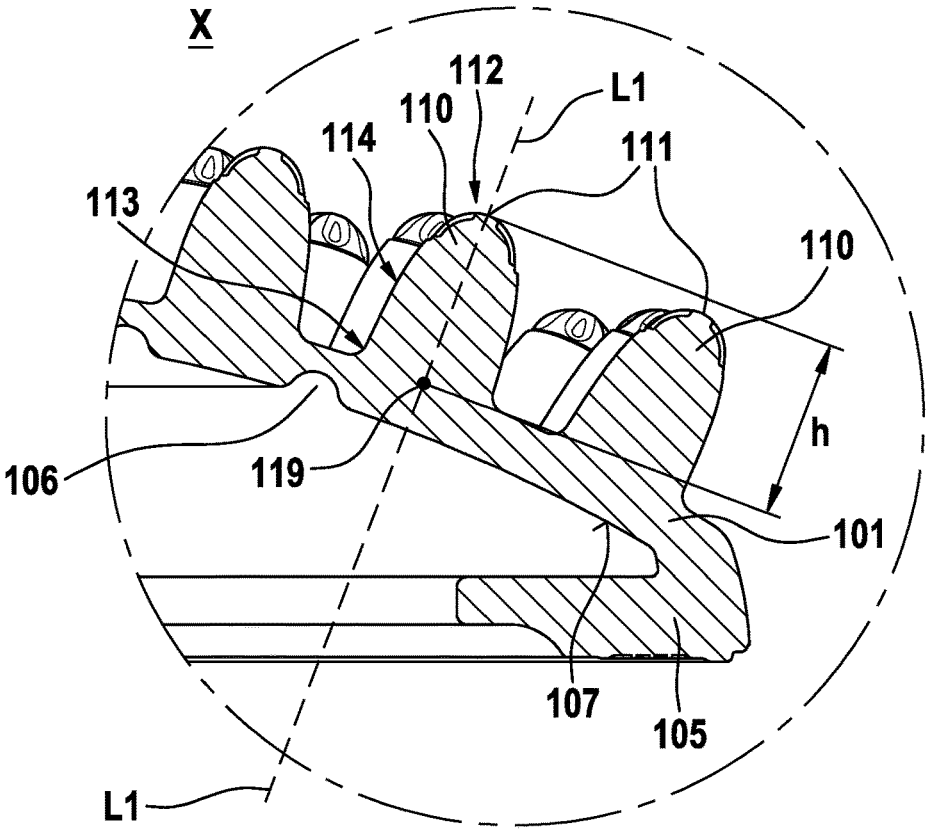
FIG. 2B is a magnification of detail X of the cross-sectional cut of the massage pad as indicated in FIG. 2A.

FIG. 2B is an enlarged detail X of the cross-sectional view onto the massage pad 100 as indicated in FIG. 2A. The detail X comprises the circumferential edge of the base 101 of the massage pad 100 with the inwards extending ring 105 and one groove-like depression 106 arranged in the inner surface 107 of the base 101. The groove-like depression 106 is arranged between massage projections 110 extending from the base surface 102 so that the intention of the groove-like depression 106 to define a predetermined bending line is achieved. In this detail drawing it can be more clearly seen that each massage projection 110 has a foot area 113 from which the respective massage projection 110 extends out of the base surface 102 of the base 101. A central area 114 follows the foot area 113, which central area 114 is here unstructured (which shall not exclude a certain surface roughness, e.g. the arithmetic average profile roughness Ra may be in the range of between 0.1 μm to 20 μm, in particular where the upper range value is 10 μm, 5 μm, 2.5 μm, or 1.0 μm, further in particular wherein the arithmetic average profile roughness is about 1 μm). The massage projection 110 is then concluded by a tip 112 having a tip center 111. The tip center 111 is the center of gravity of the tip area. As an in particular elongated depression may extend through the tip center 111, it needs not to be the highest point of the massage projection above the level of the base surface 102. The massage projections 110 are here each having a generally circular cross section and they have a diameter W at the base 112 of the massage projections 110. In the shown embodiment, the diameter W may be about 4.0 mm. The general shape of the massage projections 110 is dome-like. The dome-like shape of each of the massage projections is essentially cylinder symmetric with respect to a central axis L1 that extends through a center point 119 of the massage projection at the level of the base surface 102 and the tip center 111 (the depressions disposed at the tip 112 of the massage projections destroy the precise cylinder symmetry, but then the enveloping surface of the massage projection has the precise cylinder symmetry).

Figure 3:
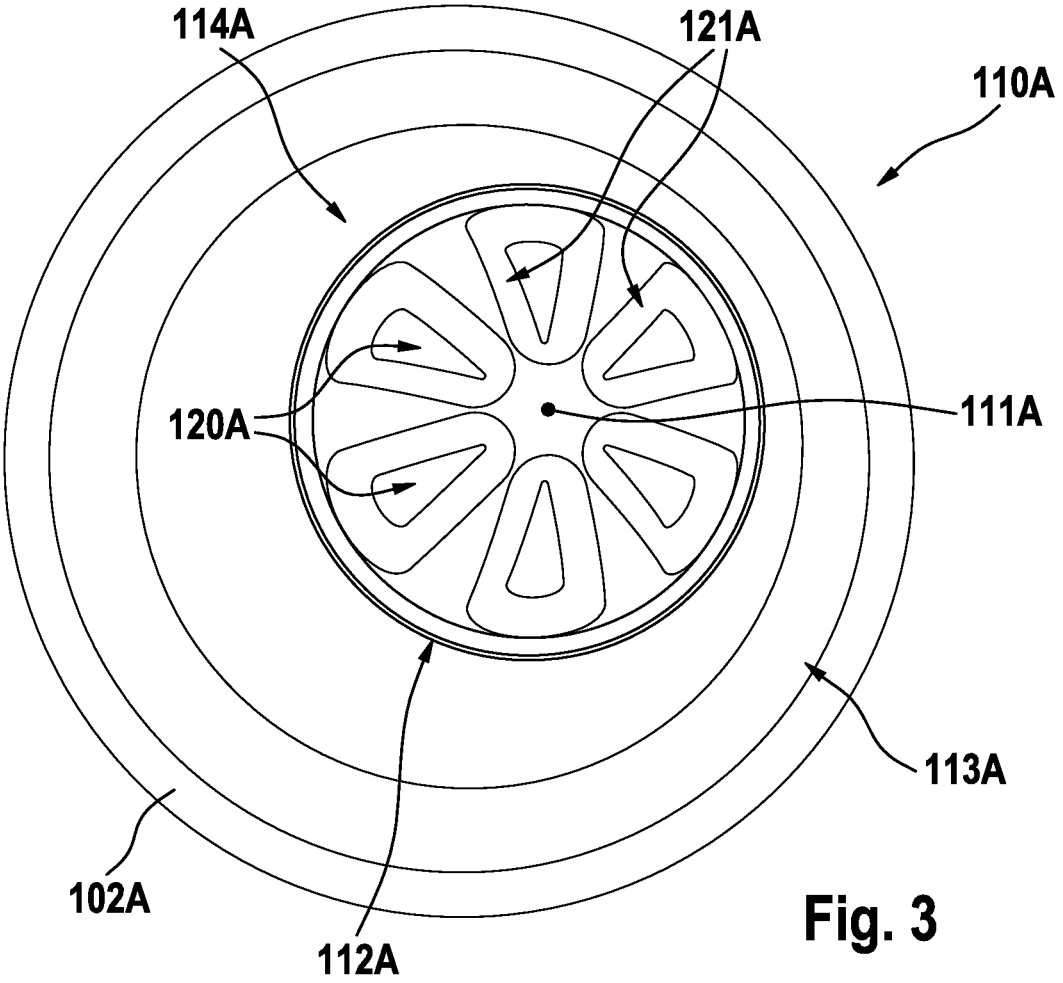
FIG. 3 is a slightly perspective top view onto an example massage projection.

FIG. 3 is a slightly perspective top view onto an individual structured massage projection 110A. The massage projection 110A extends from a base surface 102A and has a generally circular cross section and a generally dome-shaped 3D form. The massage projection 110A has a foot area 113A, a central area 114A that is essentially unstructured, and a tip 112A having a tip center 111A. In the tip 112A six elongated depression 120A are disposed, each of the depressions 120A having a closed upper edge 121A that has an edge radius suitable so that with the given material a scraping effect is achieved, e.g. the edge radius may have a value of about 0.1 mm and the material from which the massage pad is made at least at the tip(s) of the structured massage projection(s) may be a vulcanized silicone rubber having a Shore A hardness of 45. The elongated depressions 120A here extend along equiangular arranged radial lines that originate at the tip center 111A (i.e. the angle between the radial lines at the tip center 111A is 60 degrees). The elongated depressions 120A here have all the same shape and they widen towards the central area 114A (or taper towards the tip center 111A). Dead skin cells that are scraped off the skin during a massage operation may then collect in the depressions 120A.

Figure 4:
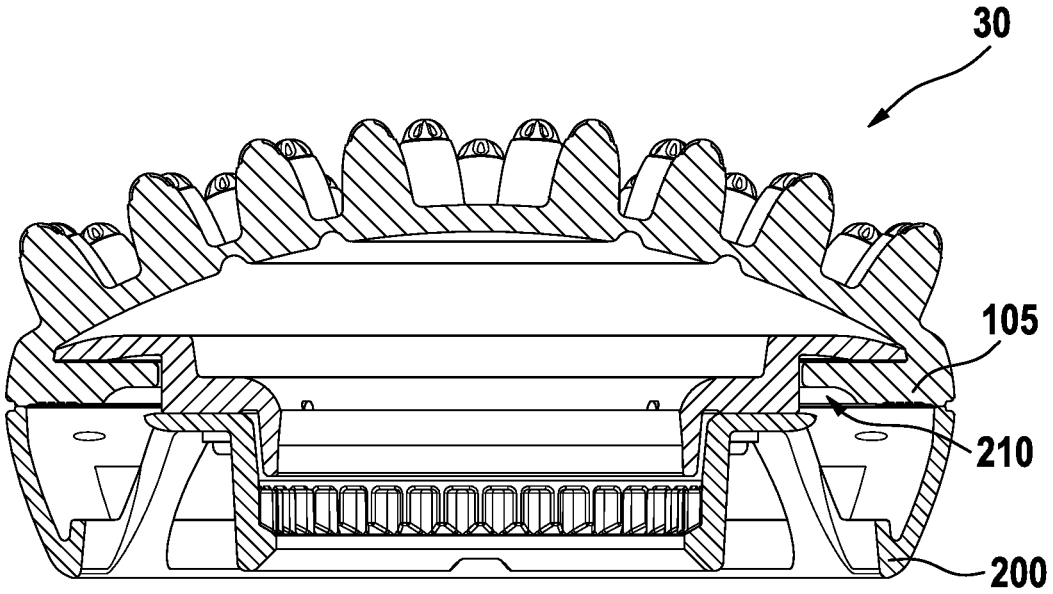
FIG. 4 is a cross sectional cut through a massage pad connected with a hard carrier.

FIG. 4 is a cross sectional shape through the massage pad 100 as shown in FIG. 2A, but where the massage pad 100 is connected with a hard carrier 200. The hard carrier 200 may be made from a hard plastic material, e.g. a polycarbonate (PC). The hard carrier 200 comprises a circumferential channel 210 into which the circumferential, inwards extending ring 105 of the massage pad 100 extends. The massage pad 100 is thus tightly attached to the hard carrier 200 but can be removed from the carrier 200, e.g. when the massage pad is worn out (e.g. when the scraping edges are grinded too round to generate the scraping effect) or when the consumer considers the massage pad to be worn out. The combination of massage pad 100 and hard carrier 200 may be considered as a (passive) massage device 30. While the massage device 30 shown in FIG. 4 is intended for being mounted at a massage attachment 10 of an electric massage device 1 (see FIGS. 5 and 6), in other embodiments, a hard carrier may be structured so as to be easily graspable by a human hand or by human fingers so that it can be used for manual massaging. FIG. 4 in particular relates to the previously mentioned independent aspect of the present disclosure, where the massage projections may be structured or unstructured and where it is important that the massage pad is convex and thus has a larger area than the flat area defined by its circumference (the massage pad may take any other shape instead of circular). The clearance between the center region of the massage pad and the carrier allows bending of the massage pad and thus its adaptation to differently contoured skin areas (here, the hard carrier defines a hollow so that the massage pad may even bend into the hollow, i.e. the massage pad can deform below the level of the hard carrier).

Figure 5:
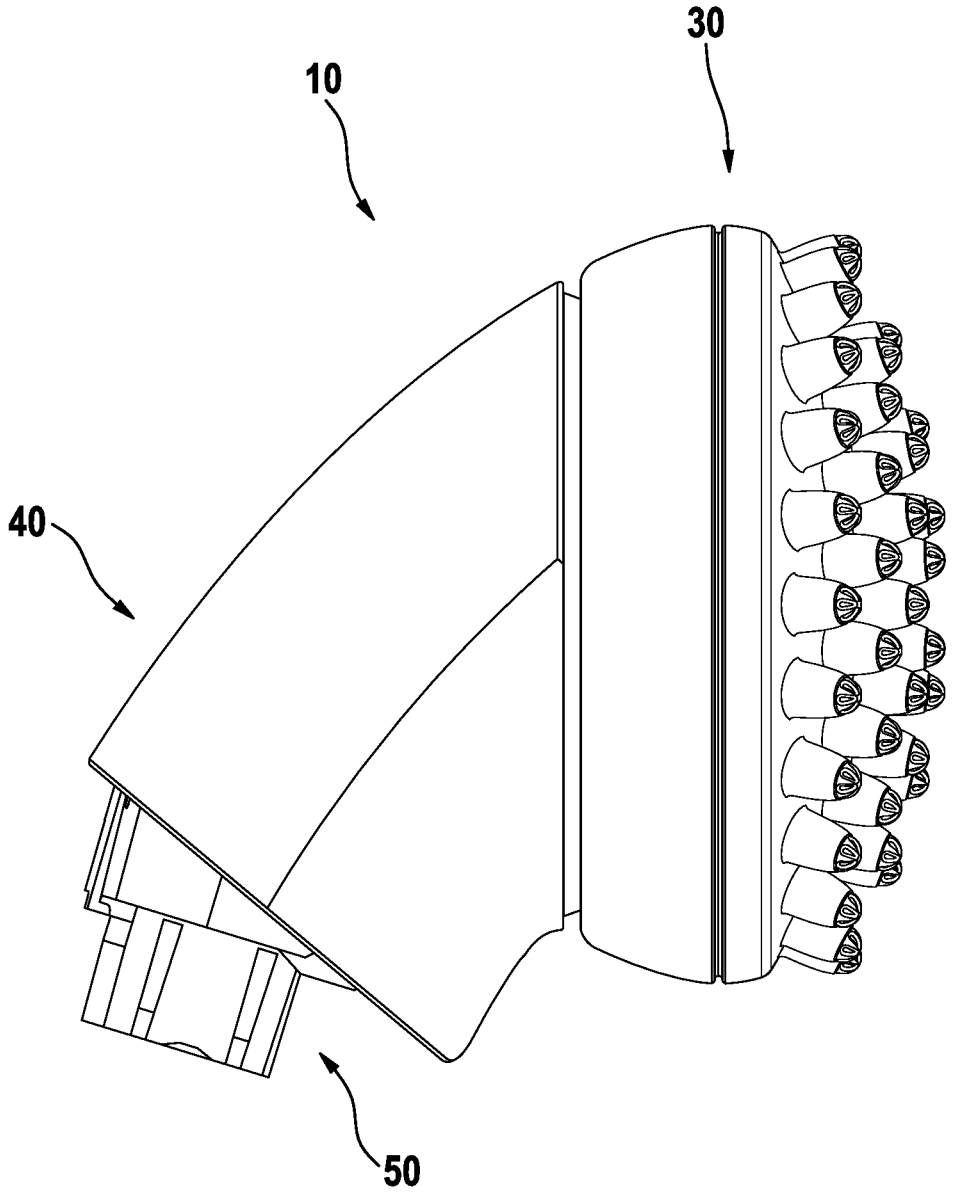
FIG. 5 is a side view onto a head attachment of a massage device, the head attachment comprising a massage pad.

FIG. 5 is a side view onto a massage attachment 10 of an electric massage device. The attachment 10 comprises a passive massage device 30 attached to a housing portion 40, where the housing portion 40 comprises a gear arrangement 50 for engagement with a drive of a handle of the electric massage device. The gear 50 is arranged to transfer a motion provided via the drive to the massage device 30 so that the passive massage device 30 (and hence the massage pad 100 tightly connected with the carrier 20 as previously described) is moved with respect to the housing 40, e.g. in a rotational manner or in an oscillatory rotational manner.

Figure 6:
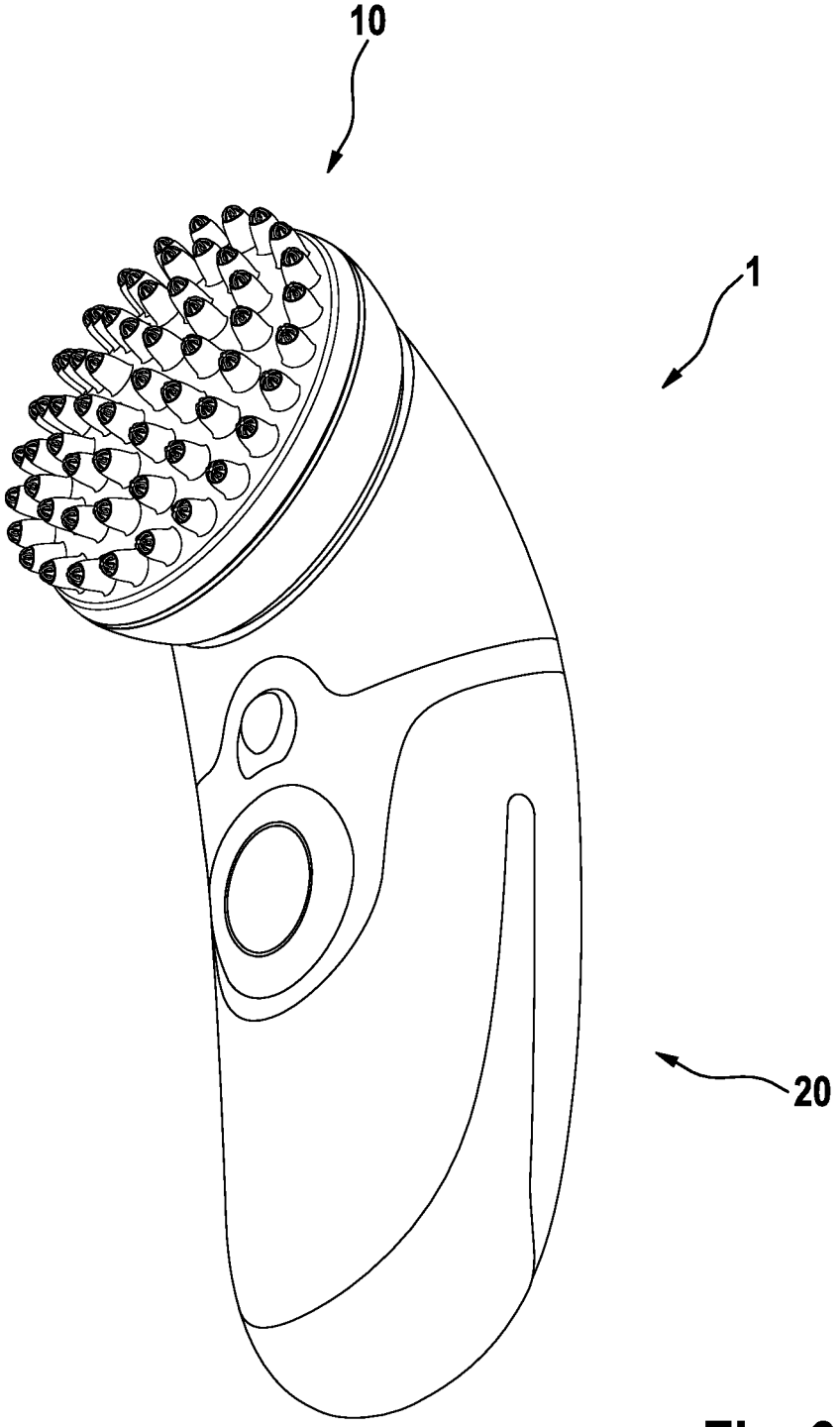
FIG. 6 is a depiction of an example massage device that is realized as an electric massage device.

FIG. 6 is a perspective view onto a massage device 1 that is arranged as an electric massage device. The massage device 1 comprises the massage attachment 10 as discussed with reference to FIG. 5 and a handle 20 that comprises a drive (not shown) and that may further comprise a battery or a rechargeable battery.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A massage device comprising:

a massage pad being made from an elastic material and having a base with a convex outer base surface, wherein the massage pad comprises at least one massage projection extending from the convex outer base surface, each massage projection having a base and a tip having a tip center; and a hard carrier, the massage pad being connected with the hard carrier at a circumference of the massage pad and a clearance being provided between the massage pad and the hard carrier at least in a center region of the massage pad, wherein the clearance is structured so that the massage pad is configured to deform into a concave state at least in the center region, wherein at least two rings concentrically arranged with respect to a center point the massage pad are provided in the base of the massage pad, each ring comprising a groove defining a deformation line for the massage pad under an applied external force.

2. The massage device in accordance with claim 1, wherein the base of the massage pad has an inner surface opposite to the convex outer base surface and wherein the two rings are provided on the inner surface of the massage pad.

3. The massage device in accordance with claim 1, wherein the massage device comprises a drive for driving the massage pad into a rotational or oscillatory rotational motion around a center axis of the massage pad.

4. The massage device in accordance with claim 1, comprising a handle and a replaceable massage attachment comprising the massage pad.

5. The massage device in accordance with claim 1, wherein the hard carrier defines a hollow into which the massage pad is configured to bend.

6. The massage device in accordance with claim 1, comprising a plurality of massage projections, wherein the two rings extend between the massage projections.

7. The massage device in accordance with claim 1, wherein the massage pad has a circular shape and comprises a plurality of massage projections that are arranged in at least two rings, each ring being arranged concentrically with respect to the center point of the massage pad.

8. The massage device in accordance with claim 7, wherein the plurality of massage projections are arranged in at least three rings.

9. The massage device in accordance with claim 7, wherein each ring comprises at least five of the massage projections.

10. The massage device in accordance with claim 1, comprising at least two massage projections extending from the convex outer base surface, wherein at least one of the massage projections comprises a structured massage projection with at least one elongated elevation or elongated depression extending at the tip.

11. The massage device in accordance with claim 10, wherein the at least one structured massage projection comprises a plurality of elongated elevations or elongated depressions that run towards the tip center.

12. The massage device in accordance with claim 11, wherein the plurality of depressions or elevations connect at the tip center.

13. The massage device in accordance with claim 10, wherein the at least one structured massage projection comprises a central area located at the tip center and a plurality of ribs that extend radially away from the central area, wherein depressions extend between the ribs.

14. The massage device in accordance with claim 13, wherein the ribs converge into a ring structure.

15. The massage device in accordance with claim 10, wherein each of the at least two massage projections has a central axis extending from the convex outer base surface and going through the respective tip center and wherein the central axis of each of the at least two massage projections is disposed perpendicular with respect to the convex outer base surface.

16. The massage device in accordance with claim 10, wherein at least the structured massage projection is made at least at the tip from an elastic material having a Young's modulus in the range of between 0.5 $N/mm^2$ and 50 $N/mm^2$.

* * * * *